US011454139B2

(12) United States Patent
Alessandria

(10) Patent No.: US 11,454,139 B2
(45) Date of Patent: Sep. 27, 2022

(54) METHOD FOR VALVETRAIN LASH ADJUSTMENT WITH EXTRA LOST MOTION STROKE AND HIGH STIFFNESS LOST MOTION SPRING

(71) Applicant: EATON INTELLIGENT POWER LIMITED, Dublin (IE)

(72) Inventor: Marco Alessandria, Trana (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/318,381

(22) PCT Filed: Jul. 18, 2017

(86) PCT No.: PCT/EP2017/068078
§ 371 (c)(1),
(2) Date: Jan. 17, 2019

(87) PCT Pub. No.: WO2018/015359
PCT Pub. Date: Jan. 25, 2018

(65) Prior Publication Data

US 2019/0234246 A1 Aug. 1, 2019

(30) Foreign Application Priority Data

Jul. 19, 2016 (GB) ..... 1612500

(51) Int. Cl.
*F01L 1/18* (2006.01)
*F01L 1/20* (2006.01)
*F01L 1/46* (2006.01)

(52) U.S. Cl.
CPC ..... *F01L 1/181* (2013.01); *F01L 1/20* (2013.01); *F01L 1/46* (2013.01); *F01L 2001/467* (2013.01)

(58) Field of Classification Search
None
See application file for complete search history.

(56) References Cited

U.S. PATENT DOCUMENTS 2,669,228 A * 2/1954 Bergmann ..... F01L 1/20 123/90.47
3,964,172 A 6/1976 Wright
6,085,705 A * 7/2000 Vorih ..... F01L 1/18 123/90.12
8,215,275 B2 7/2012 Church et al.
(Continued)

FOREIGN PATENT DOCUMENTS

CN 1856638 A 11/2006
CN 102292524 B 12/2013
(Continued)

*Primary Examiner* — Devon C Kramer
*Assistant Examiner* — Wesley G Harris
(74) *Attorney, Agent, or Firm* — Mei & Mark, LLP

(57) ABSTRACT

A method for setting lash on a rocker arm assembly having a lost motion stroke includes: providing a rocker arm having a lost motion shaft including a collar, the lost motion shaft being biased toward a valve bridge by a lost motion spring, the lost motion shaft being translatable along a bore defined in the rocker arm; inserting a feeler gage in an area between the collar and the rocker arm; and adjusting an adjusting screw until a desired lash is attained.

11 Claims, 4 Drawing Sheets

(56) References Cited

U.S. PATENT DOCUMENTS

| | | | | |
|---|---|---|---|---|
| 9,016,249 | B2 * | 4/2015 | Roberts | F01L 1/18 123/90.16 |
| 9,429,051 | B2 * | 8/2016 | Meneely | F01L 1/181 |
| 2003/0024501 | A1 * | 2/2003 | McCarthy | F01L 13/065 123/321 |
| 2006/0090604 | A1 * | 5/2006 | Waal | B25B 13/48 81/9.24 |
| 2010/0170472 | A1 | 7/2010 | Yang | |
| 2011/0005484 | A1 * | 1/2011 | Yasui | F01L 1/143 123/90.54 |
| 2011/0017161 | A1 * | 1/2011 | Yasui | F01L 1/181 123/90.54 |
| 2014/0083381 | A1 * | 3/2014 | Roberts | F01L 1/08 123/90.15 |
| 2014/0290609 | A1 * | 10/2014 | Radhakrishnan | F01L 1/18 123/90.45 |
| 2016/0084118 | A1 * | 3/2016 | Nichols | F01L 1/185 123/90.36 |

FOREIGN PATENT DOCUMENTS

| | | | | |
|---|---|---|---|---|
| CN | 104061033 | B | 11/2020 | |
| EP | 0079603 | A1 | 5/1983 | |
| JP | 02145605 | A | 6/1990 | |
| JP | 0565810 | A | 3/1993 | |
| JP | 06299809 | A | 10/1994 | |
| JP | 1077812 | A | 3/1998 | |
| JP | 2009222053 | A * | 10/2009 | F01L 1/22 |
| WO | WO 2015120897 | A1 | 8/2015 | |

* cited by examiner

METHOD FOR VALVETRAIN LASH ADJUSTMENT WITH EXTRA LOST MOTION STROKE AND HIGH STIFFNESS LOST MOTION SPRING

CROSS-REFERENCE TO PRIOR APPLICATIONS

This application is a U.S. National Phase application under 35 U.S.C. § 371 of International Application No. PCT/EP2017/068078, filed on Jul. 18, 2017, and claims benefit to British Patent Application No. GB 1612500.7, filed on Jul. 19, 2016. The International Application was published in English on Jan. 25, 2018 as WO 2018/015359 under PCT Article 21(2).

FIELD

The present disclosure relates generally to setting lash in a valvetrain of an internal combustion engine that incorporates an extra lost motion stroke and a high stiffness lost motion spring.

BACKGROUND

Variable valve actuation (VVA) technologies have been introduced and documented. One VVA device may be a variable valve lift (VVL) system, a cylinder deactivation (CDA) system such as that described in U.S. Pat. No. 8,215,275 entitled "Single Lobe Deactivating Rocker Arm" hereby incorporated by reference in its entirety, or other valve actuation systems. Such mechanisms are developed to improve performance, fuel economy, and/or reduce emissions of the engine. One configuration used to modify valve timing and lift includes a lost motion device provided in a rocker arm assembly generally between the valves and the cam. In some examples it can be difficult to properly set lash in such mechanical systems that incorporate a lost motion stroke.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In an embodiment, the present invention provides a method for setting lash on a rocker arm assembly having a lost motion stroke, the method comprising: providing a rocker arm having a lost motion shaft including a collar, the lost motion shaft being biased toward a valve bridge by a lost motion spring, the lost motion shaft being configured to translate along a bore defined in the rocker arm; inserting a feeler gage in an area between the collar and the rocker arm; and adjusting an adjusting screw until a desired lash is attained.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
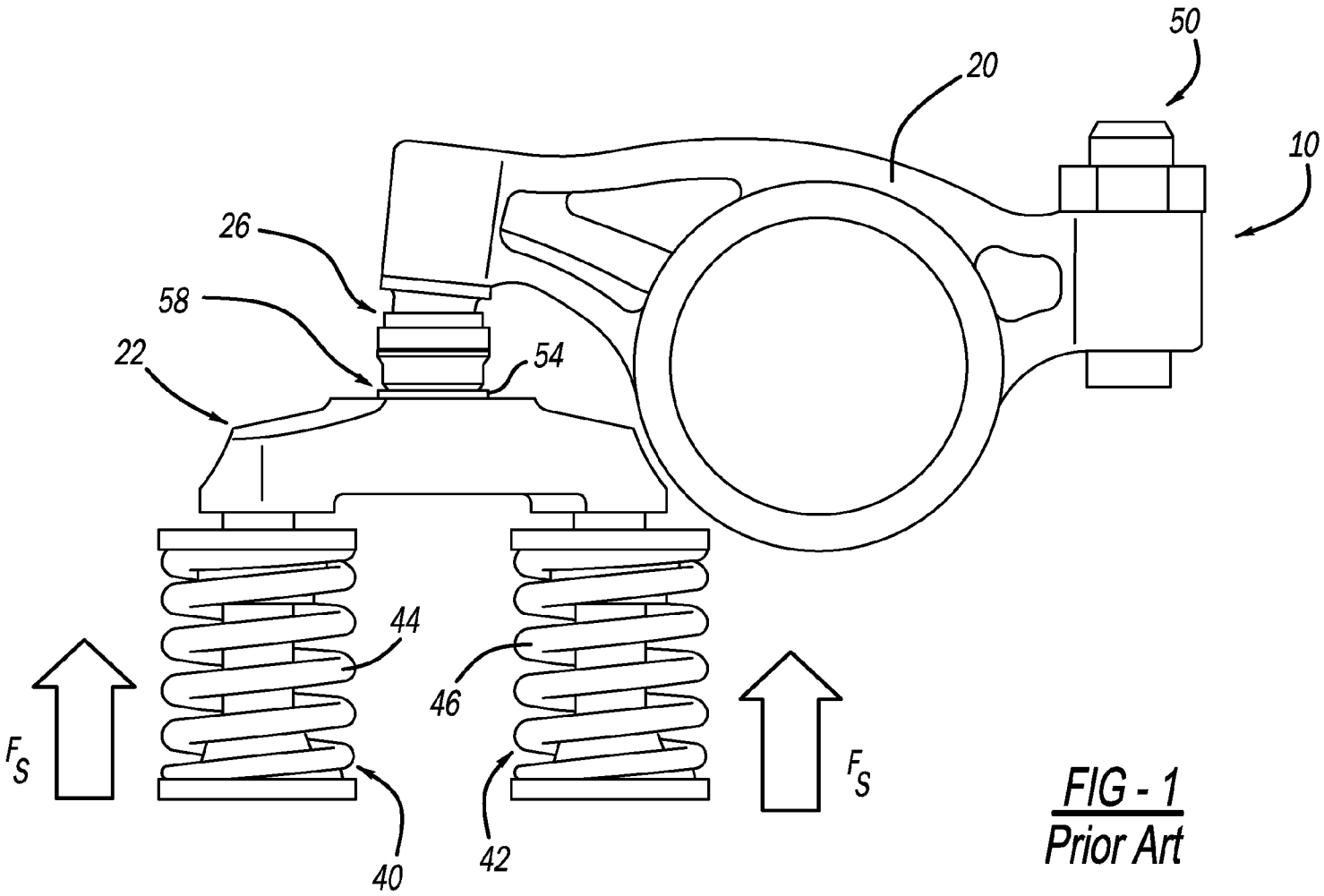
FIG - 1 Prior Art
FIG. 1 is front view of a rocker arm and bridge assembly constructed in accordance to prior art and illustrating an area for feeler gage insertion according to one example of prior art.

A method for setting lash on a rocker arm assembly having a lost motion stroke includes providing a rocker arm having a lost motion shaft including a collar. The lost motion shaft can be biased toward a valve bridge by a lost motion spring. The lost motion shaft can be configured to translate along a bore defined in the rocker arm. A feeler gage can be inserted in an area between the collar and the rocker arm. An adjusting screw is adjusted until a desired lash is attained.

According to additional features, an operator verifies that the feeler gage is slightly pinched between the collar and the rocker arm. The collar and the rocker arm can be moved toward each other and the feeler gage during the adjusting. The lost motion shaft can be moved toward the rocker arm against a bias of the lost motion spring during the adjusting. The collar and the rocker arm can be concurrently engaged with the feeler gage during the adjusting. The valve bridge comprises a wall that inhibits insertion of the feeler gage between the bridge and an e-foot associated with the lost motion shaft.

An e-foot disposed on the lost motion shaft can be located onto the valve bridge during the inserting. Locating the e-foot can include positioning the e-foot onto a nesting area defined by a raised wall extending from the valve bridge. Positioning the e-foot onto the nesting area includes locating the e-foot onto the nesting area that is bounded by a front wall, a rear wall and a side wall.

A rocker arm assembly constructed in accordance to one example of the present disclosure includes a rocker arm and a valve bridge. The rocker arm has a lost motion shaft including a collar. The lost motion shaft is biased by a lost motion spring. The lost motion shaft is configured to translate along a bore defined in the rocker arm. The valve bridge is configured to be acted on by an e-foot disposed on the lost motion shaft. The valve bridge includes a raised wall formed thereon. The raised wall defines a nesting area for receiving the e-foot. The raised wall inhibits passage of a feeler gage between the e-foot and the valve bridge.

In other features, the raised wall further includes a front wall, a rear wall and a side wall. The front and rear wall oppose each other. The e-foot defines a footprint that is at least partially surrounded by the raised wall in the nesting area. The e-foot is bound by the raised wall in the nesting area. The valve bridge has an e-foot engaging surface on the nesting area that is at least partially bordered by the raised wall. The e-foot is recessed into the nesting area when the e-foot is engaged to the e-foot engaging surface of the valve bridge. The valve bridge has an open area opposite the side wall.

A method for setting lash on a rocker arm assembly having a lost motion stroke is provided. The rocker arm includes a lost motion shaft having a collar. The lost motion shaft is biased toward a valve bridge by a lost motion spring. The method includes identifying a gage placement area between the collar and the valve bridge. A feeler gage is inserted at the gage placement area. An adjusting screw is adjusted until a desired lash is attained. A user verifies that the feeler gage is pinched between the collar and the rocker arm. The lost motion shaft is moved toward the rocker arm against a bias of the lost motion spring. The collar and the rocker arm are concurrently engaged with the feeler gage.

With initial reference to FIG. 1, a rocker arm assembly constructed in accordance to one example of prior art is shown and generally identified at reference 10. The rocker arm assembly 10 generally includes a rocker arm 20, a valve bridge 22, an elephant foot or e-foot 26 and a pair of engine valves 40, 42 that cooperate with a respective pair of valve springs 44, 46. The valve bridge 22 can urge the engine valves 40, 42 toward an open position. An adjusting screw 50 is provided for cooperating with the rocker arm 20 during lash adjustment as is known in the art. During lash setting on the rocker arm assembly 10 a feeler gage 54 is placed in an area 58 between the e-foot 26 and the valve bridge 22. No forces are acting on the rocker arm 20 until when the lash is set at the proper value. When lash is set, the feeler gage 54 will be slightly pinched between the e-foot 26 and the bridge 22 by the reaction force of the valve springs 44, 46 to the valve opening.

Figure 2:
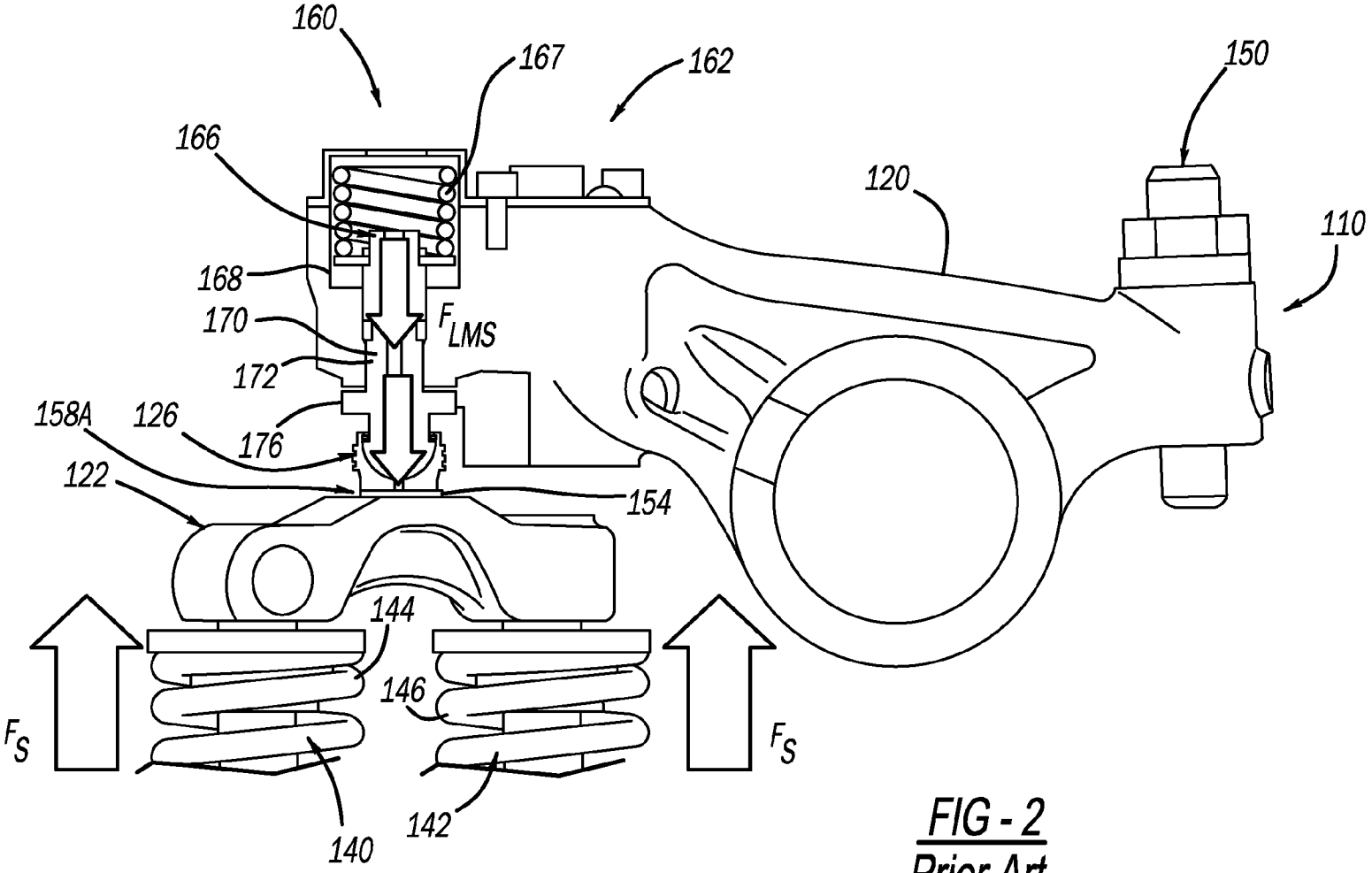
FIG - 2 Prior Art
FIG. 2 is a front partial sectional view of a rocker arm assembly configured for use with a lost motion stroke and mechanical lash according to prior art and illustrating an area for feeler gage insertion according to one example of prior art.

Turning now to FIG. 2, a rocker arm assembly constructed in accordance to another example of prior art is shown and generally identified at reference 110. The rocker arm assembly 110 generally includes a rocker arm 120, a valve bridge 122, an elephant foot or e-foot 126 and a pair of engine valves 140, 142 that cooperate with a respective pair of valve springs 144, 146. An adjusting screw 150 is provided for cooperating with the rocker arm 120 during mechanical lash adjustment as is known in the art. The rocker arm assembly 110 further is configured for a lost motion stroke and includes a spigot assembly 160 and a capsule or hydraulic lash adjuster (HLA) 162. The spigot assembly 160 can include a lost motion shaft 166 that has a distal end that is received by the e-foot 126 and a proximal end that extends into a bore 168 defined in the rocker arm 120. The lost motion shaft 166 is biased toward the valve bridge 122 by a lost motion spring 167. A central shaft portion 170 slidably translates within a complementary bore 172 defined in the rocker arm 120. A collar 176 can extend from the central shaft portion 170. During lash setting on the rocker arm assembly 110 a feeler gage 154 is placed in a first gage placement area 158A between the e-foot 126 and the valve bridge 122.

In a system with a lost motion stroke and mechanical lash, such as the rocker arm assembly 110 shown in FIG. 2, the valvetrain is always loaded by the force of the lost motion spring 167. As such, no clearance is available between the e-foot 126 and the valve bridge 122. When the lost motion force is relatively high and the feeler gage 154 is inserted below the e-foot 126, the operator could feel it slightly pinched. In this regard, it may be difficult to accurately assess and therefore set lash. Explained further, the resistance perceived by the operator during rotation of the adjusting screw 150 may not accurately represent lash. When correct lash is reached, the feeler gage 154 is slightly pinched between the rocker arm 120 and the valve bridge 122. The extra lost motion stroke and stiff lost motion spring 167 apply the load directly on the valve bridge 122. There could be a risk to feel the feeler gage 154 slightly pinched when the lash is not already set at the proper value. In this regard, using the feeler gage 154 between the rocker arm 120 and the valve bridge 122 can provide inconsistent and sometimes unreliable results.

Figure 3:
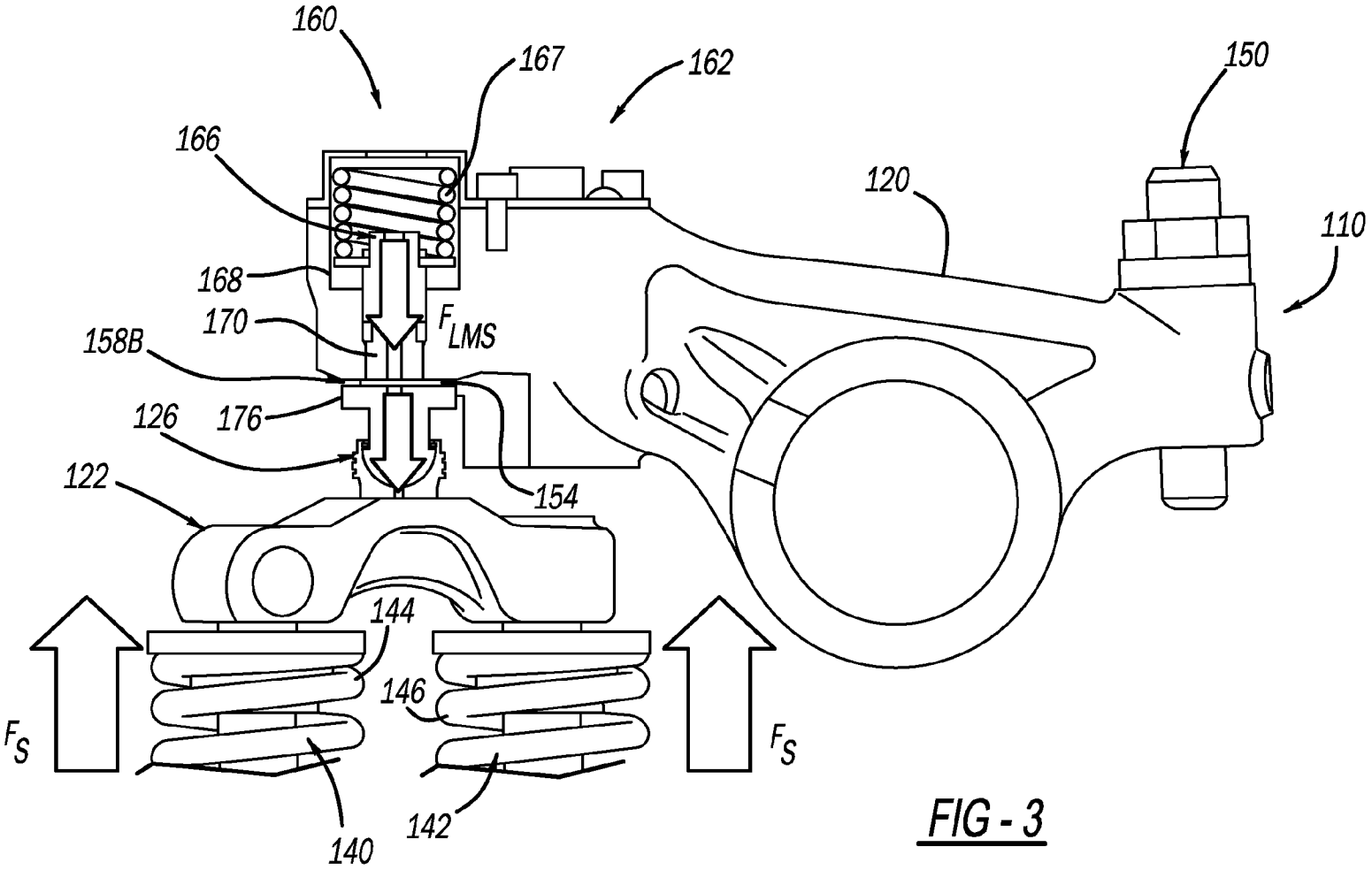
FIG. 3 is a front partial sectional view of the rocker arm assembly of FIG. 2 and shown with an area for feeler gage insertion according to one example of the present disclosure.

With reference now to FIG. 3, a method of setting lash according to one example of the present teachings will be described. The feeler gage 154 is inserted into a second gage placement area 158B between the collar 176 of the lost motion shaft 166 and the rocker arm 120. As a result, the lash regulation is not affected by the lost motion force of the lost motion spring 167. The feeler gage 154 is then slightly pinched just when the lash is set at the proper value, allowing the operator to use the required force to compress the lost motion spring 167 without the risk of improperly setting the lash. The operator can apply all the necessary force to the adjusting screw 150 to compress the lost motion spring 167 without the risk to pinch the feeler gage 154 before reaching the proper lash value. Adjusting the adjusting screw 150 includes moving the collar 176 and the rocker arm 120 toward each other and the feeler gage 154. Adjusting the adjusting screw 150 continues until an operator verifies that the feeler gage 154 is slightly pinched between the collar 176 and the rocker arm 120. The operator can verify lash is set when the feeler gage 154 is contacted by both the rocker arm 120 and the collar 176.

Figure 4:
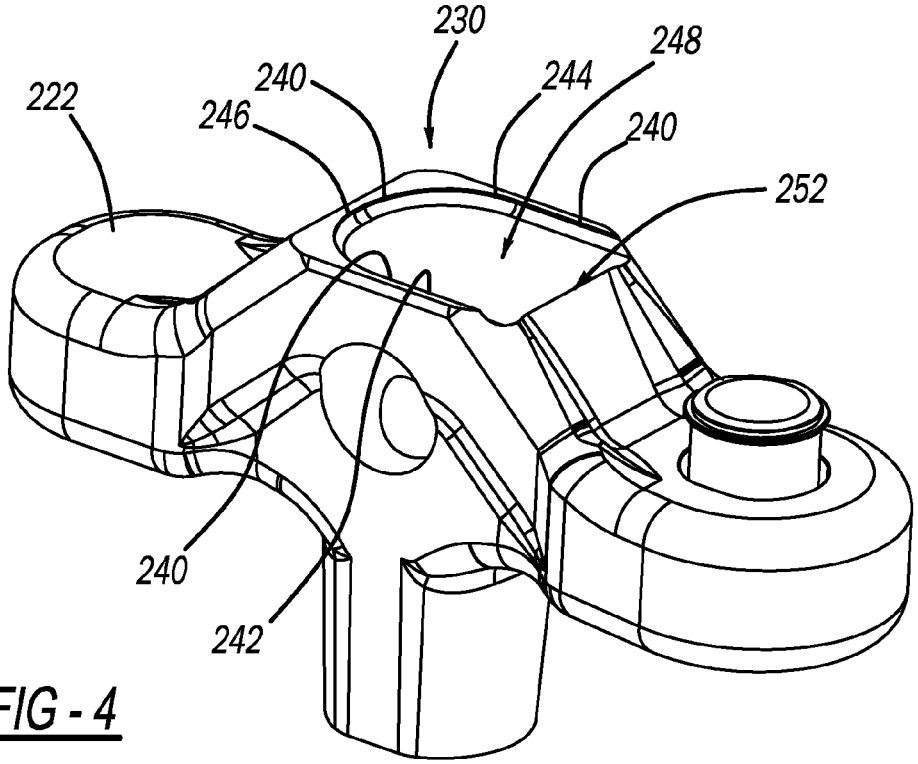
FIG. 4 is a front perspective view of a valve bridge constructed in accordance to one example of the present disclosure.
Figure 5:
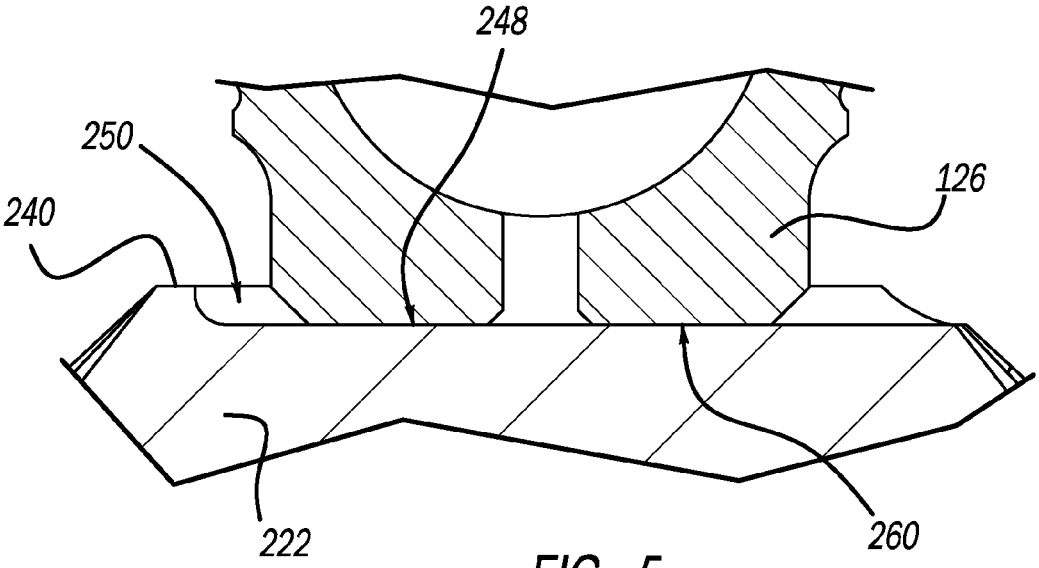
FIG. 5 is a partial sectional view of the valve bridge of FIG. 4.

With additional reference now to FIGS. 4 and 5, a valve bridge 222 constructed in accordance to additional features of the present disclosure will be described. The valve bridge 222 may be used in the rocker arm assembly 110 described above in place of the valve bridge 122. As will become appreciated from the following discussion, the valve bridge 222 incorporates geometry that will inhibit placement of the feeler gage 154 in the traditional location 158A (FIG. 2) between the e-foot 126 and the valve bridge 122.

The geometry of the valve bridge 222 provides a feeler gage protection feature 230 having a raised wall collectively referred to at reference 240. The raised wall 240 can more specifically include a front wall 242, a rear wall 244 and a side wall 246. The front wall 242, the rear wall 244 and the side wall 246 extend proud from the valve bridge 222 and generally form a border around an e-foot engaging surface 248. The front wall 242 and the rear wall 244 oppose each other. The front wall 242, the rear wall 244 and the side wall 246 cooperate to define a nesting area 250 for receiving the e-foot 126. An opening 252 is defined opposite the side wall 246. The e-foot 126 is therefore generally bordered on three sides by the respective front wall 242, the rear wall 244 and the side wall 246 when engaged to the valve bridge 222 at the e-foot engaging surface 248. In this way, the e-foot 126 locates generally below the raised wall 240 therefore blocking easy entrance of a feeler gage 154. The e-foot 126 defines a footprint 260 that is bound on three sides by the raised wall 240 in the nesting area 250. In some examples, because traditional placement of the feeler gage 154 is inhibited, an operator may search an operators manual to determine proper placement (e.g., at the second gage placement area 158B, FIG. 3).

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A method for setting lash on a rocker arm assembly having a lost motion stroke, the method comprising:

providing the rocker arm assembly comprising a rocker arm and a valve bridge, wherein the rocker arm comprises a first end, a bore defined at the first end, a lost motion shaft inside the bore and being configured to translate along the bore, a lost motion spring, an e-foot, and a second end disposed with an adjusting screw; the lost motion shaft comprises a proximal end, a central shaft portion, a collar, and a distal end; the proximal end of the lost motion shaft extends into the bore and is biased by the lost motion spring toward the valve bridge; the collar is located on the central shaft portion on the lost motion shaft and has a diameter larger than the central shaft portion; and the distal end extends outside the bore of the rocker arm and is disposed with the e-foot;

inserting a feeler gage in an area on the central shaft portion between the collar and the rocker arm;

compressing the lost motion spring by adjusting the adjusting screw and moving the collar and the rocker arm toward the feeler gage; and adjusting the adjusting screw until a desired lash is attained, wherein the valve bridge comprises a wall that inhibits insertion of the feeler gage between the valve bridge and the e-foot, and the wall comprises a front wall, a rear wall, and a side wall defining an opening opposite the side wall.

2. The method of claim 1, wherein adjusting the adjusting screw until the desired lash is attained further comprises:

verifying the feeler gage is slightly pinched between the collar and the rocker arm.

3. The method of claim 2, wherein adjusting the adjusting screw until the desired lash is attained comprises:

moving the collar and rocker arm toward each other and the feeler gage.

4. The method of claim 1, wherein adjusting the adjusting screw until the desired lash is attained comprises:

moving the lost motion shaft toward the rocker arm against a bias of the lost motion spring.

5. The method of claim 1, wherein adjusting the adjusting screw until the desired lash is attained comprises:

concurrently engaging the collar and the rocker arm with the feeler gage.

6. The method of claim 1, further comprising:

locating the e-foot disposed on the lost motion shaft onto the valve bridge during the inserting.

7. The method of claim 6, wherein locating the e-foot further comprises:

positioning the e-foot onto a nesting area defined by the wall.

8. The method of claim 7, wherein positioning the e-foot onto the nesting area includes locating the e-foot onto the nesting area, the nesting area being bounded by the front wall, the rear wall, and the side wall.

9. A method for setting lash on a rocker arm assembly having a lost motion stroke, comprising:

providing the rocker arm assembly comprising a rocker arm and a valve bridge, wherein the rocker arm comprises a first end, a bore defined at the first end, a lost motion shaft inside the bore and being configured to translate along the bore, a lost motion spring biasing the lost motion shaft toward the valve bridge, an e-foot, and a second end disposed with an adjusting screw; the lost motion shaft comprises a proximal end, a central shaft portion, a collar located on the central shaft portion, and a distal end; the proximal end of the lost motion shaft extends into the bore and is biased by the lost motion spring toward the valve bridge; and the distal end of the lost motion shaft extends outside the bore of the rocker arm and is disposed with the e-foot;

inserting a feeler gage in an area on the central shaft portion between the collar and the rocker arm;

compressing the lost motion spring by adjusting the adjusting screw without pinching the feeler gage and moving the collar and the rocker arm toward each other and the feeler gage; and continuing to adjust the adjusting screw and move the collar and the rocker arm to attain a desired lash.

10. The method of claim 9, wherein the valve bridge comprises a wall that inhibits insertion of the feeler gage between the valve bridge and the e-foot, and the wall comprises a front wall, a rear wall, and a side wall defining an opening opposite the side wall.

11. The method of claim 9, further comprising verifying that the feeler gage is slightly pinched between the collar and the rocker arm to attain the desired lash.

* * * * *